US006255997B1

(12) United States Patent
Ratkorn et al.

(10) Patent No.: US 6,255,997 B1
(45) Date of Patent: Jul. 3, 2001

(54) ANTENNA REFLECTOR HAVING A CONFIGURED SURFACE WITH SEPARATED FOCUSES FOR COVERING IDENTICAL SURFACE AREAS AND METHOD FOR ASCERTAINING THE CONFIGURED SURFACE

(75) Inventors: Norbert Ratkorn, Munich; Michael Truemper, Neubiberg; Christian Hunscher, Sauerlach; Robert Sekora, Kirchseeon, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/455,189

(22) Filed: Dec. 6, 1999

(30) Foreign Application Priority Data

Sep. 20, 1999 (DE) ..... 199 45 062

(51) Int. Cl.[7] ..... H01Q 19/10
(52) U.S. Cl. ..... 343/832; 343/781 R; 343/840
(58) Field of Search ..... 343/832, 840, 343/786, 781 CA, 781 R, 781 P, 779

(56) References Cited

U.S. PATENT DOCUMENTS

| | | | |
|---|---|---|---|
| 4,298,877 | 11/1981 | Sletten | 343/784 CA |
| 4,482,897 | 11/1984 | Dragone et al. | 343/779 |
| 4,603,334 * | 7/1986 | Mizuguchi et al. | 343/781 P |
| 4,712,111 * | 12/1987 | Ohta et al. | 343/779 |
| 5,402,137 | 3/1995 | Ramanujam et al. | 343/781 P |
| 5,684,494 | 11/1997 | Nathrath et al. | 343/784 P |

FOREIGN PATENT DOCUMENTS

| | | |
|---|---|---|
| 0593903 | 4/1994 | (EP) . |
| 0915529 | 5/1999 | (EP) . |
| 0920076 | 6/1999 | (EP) . |
| 53-15044 | 10/1978 | (JP) . |
| 57-73506 | 5/1982 | (JP) . |
| 5-152835 | 6/1993 | (JP) . |

* cited by examiner

*Primary Examiner*—Tan Ho
(74) *Attorney, Agent, or Firm*—W. F. Fasse; W. G. Fasse

(57) ABSTRACT

A reflector for reflecting electromagnetic waves has a configured surface for these waves whereby localized deformations or configurations such as bumps (B) and dents (D) of the reflector (1) are so constructed that the reflector cooperates with several focuses (10A, 10B; 110A, 110B) which are spatially separated from the reflector proper. These focuses are so arranged that the electromagnetic beams emanating from the respective radiators (4A, 4B; 40A, 40B) and are directed onto the reflector can be directed through the reflector onto a common region (3A, 3B) to be illuminated, whereby particularly the beams may be tuned to different frequencies or for operation in different frequency bands. Such reflectors are particularly useful in antenna systems for communications such as satellite communications.

15 Claims, 4 Drawing Sheets

ANTENNA REFLECTOR HAVING A CONFIGURED SURFACE WITH SEPARATED FOCUSES FOR COVERING IDENTICAL SURFACE AREAS AND METHOD FOR ASCERTAINING THE CONFIGURED SURFACE

PRIORITY CLAIM

This application is based on and claims the priority under 35 U.S.C. §119 of German Patent Application 199 45 062.5, filed on Sep. 20, 1999 the entire disclosure of which is incorporated herein by reference.

FIELD OF THE INVENTION

The invention relates to an antenna reflector for electromagnetic waves. The antenna reflector has a configured surface for reflecting beams emanating from spatially separated focuses or rather radiators positioned in these focuses for illuminating identical or common regions. The invention also relates to a system with such antennas. The radiators may be transmitters or receivers.

BACKGROUND INFORMATION

Reflectors having a configured surface configuration are known in the art. For example, European Patent Publication EP 0,920,076 discloses an antenna system with a reflector having a configured surface, whereby two beams or two bundles of rays emanating from two separate radiators are focused onto two different regions.

European Patent Publication EP 0,915,529 discloses a possibility for forming a single beam which is directed onto a region to be illuminated and which is formed with the aid of a reflector having a configured surface for collecting several beams emanating from several radiators which are connected together through a suitable distribution network.

U.S. Pat. No. 4,298,877 describes a reflector having a configured surface for focusing two beams onto two different receivers or rather receiver antennas of a satellite.

U.S. Pat. No. 5,684,494 discloses the focusing of separate beams having different polarities by means of a reflector arrangement comprising two reflectors. Each of the reflectors is constructed as a grid reflector so that it is effective only for one of the polarizations.

Conventional reflectors are of limited use for applications in which a bi-directional beam transmission (transmitting and receiving) is required with an effective decoupling of the transmitting direction from the receiving direction toward and from a single common region to be illuminated. The usefulness of conventional reflectors for the just mentioned purposes is rather limited especially if it shall be possible to use the same frequency and/or the same polarizations for the transmitting direction and the receiving direction. Thus, conventional reflectors have been subject to the following problems. In the case of a simple construction of the system using a single radiator for transmission and reception, there is an insufficient decoupling between the transmission direction and the reception direction of the electromagnetic radiation. Such decoupling must be achieved by additional structural components in the system such as diplexer circuits for separate transmission and receiving frequencies as is customary in conventional communication technology. When the transmission and reception frequency are the same, circulators must be used as is customary in radar technology. Producing or processing the electromagnetic radiation by these additional circuit components is costly.

In those conventional systems in which a decoupling of transmission and reception frequencies is to be accomplished, several radiators are required also resulting in costly structures as is the case for example in U.S. Pat. No. 5,684,494. However, the use of separate reflectors limits the number of useable polarization directions because different polarization directions must be provided for the transmission direction and for the reception direction. Thus, the data volume that can be transmitted through conventional systems is markedly limited.

OBJECTS OF THE INVENTION

In view of the forgoing it is the aim of the invention to achieve the following objects singly or in combination:

- to provide an antenna reflector and system that makes possible a decoupled bidirectional transmission of electromagnetic waves while simultaneously achieving a maximal or at least an optimal data volume transmission;
- to configure the reflecting surface of an antenna reflector in such a way that the reflector is capable of transmitting beams from separate radiators onto a common region, for example on the earth's surface;
- to provide an antenna system with such a reflector for the bidirectional transmission of electromagnetic waves with a single reflector; and
- to provide a method for ascertaining the antenna reflector surface configurations.

SUMMARY OF THE INVENTION

According to the invention there is provided a reflector for electromagnetic waves, said reflector comprising a reflector body having a configured reflector surface, said configured reflector surface comprising a plurality of localized surface areas, said reflector further comprising at least one group of spatilly separated focises, each of said localized surface areas having a surface topography with bumps and dents adapted for cooperation with said at least one group of spatially separated focuses for directing electromagnetix beams emanating from said respective group of spatially separated focuses onto a region to be illuminated by said electromagnetic beams or for receiving electromagentic beams emanating from a respective region, and wherein said bumps and dents of said localized surface areas have progressively smaller dimensions starting from a given first dimension of the bumps and dents of a first localized surface area of said configured reflector surface.

The present reflector is used in an antenna system according to the invention wherein the antenna system comprises at least one group of radiators with a first radiator and a second radiator forming said at least one group, whereby the first radiators are spatially separated from the reflector body proper, and wherein the first and the second radiator are arranged in respective focuses of the reflector so that first radiation beams emanating from the first radiator and second radiation beams emanating from the second radiator are directed onto a common region to be illuminated, for example on a surface region of the earth.

A method for determaining a surface configuration for a reflector for electromagnetic waves, said method comprising the following steps:

(a) stimulating a base reflector surface configuration of said reflector, (b) defining spatial separated positions of radiators relative to said base reflector surface configuration in such a way that each radiator illuminates at least one localized reflector surface area of said reflector surface configuration, (c) determining a reflectoion efefct of said refector surface configuration relative to electromagnetic beams emanating from radiators located inn said spatially separated positions defined in step (b), (d) varying a topography in the form of bumps and dents of said at least one localized reflector surface area by making said bumps and dents progressively smaller than any bumps and dents of a preceding topography so that electromagnetic beams emanating from said radiators are directed onto a common region to be illuminated, and (e) repeating steps (c) and (d) with progressively smaller dimensions of said bumps and dents until a defined directional effect of said electromagnetic beams onto said common region to be illuminated is achieved.

In this context the term "beam" or "beams" refers to a bundle or bundles of rays, respectively. The term "region to be illuminated" means a surface where beams reflected by the present reflector are received.

In another embodiment a reflector according to the invention comprises several groups of focuses, whereby beams emanating from one group of focuses are directed by the reflector onto a common or identical region to be illuminated. The beams from one group or from another group may be focused onto a common point to be illuminated, for example a remote receiver antenna in the region to be illuminated. Moreover, it is possible that the beams from several groups of focuses have a certain overlapping expansion in the region to be illuminated. This overlapping expansion can be adapted to the shape of the region to be illuminated, for example a portion of the earth's surface. For reception in the opposite beam direction emanating from the illuminated area toward the focuses of the reflector, the focusing in this embodiment takes place onto all focuses so that a receiver is basically arranged in each of the focuses or may be arranged in each of the focuses. The directional effect or the focusing effect of the reflector is hereby independent of the frequency or of the polarization of the beams.

According to another embodiment of the invention the reflector has a frequency selecting capability or effect. This means that focuses positioned in different spatial positions are provided for different frequencies or different frequency bands. The effect of the spatial separation of the focuses for different frequencies or frequency bands is amplified. In this second embodiment the beams emanating from one group of focuses are also directed by the reflector onto a common or identical region to be illuminated. However, in the opposite direction a focusing for each frequency or each frequency band takes place only onto one of the focuses. Accordingly, a receiver for a certain frequency or for a certain frequency band is to be arranged in the respective focus.

In one type of operation the present reflector can be used in a two-fold manner. On the one hand, beams which are emanating from a transmitter positioned in one focus can be directed onto the region to be illuminated. On the other hand, beams emanating from the region to be illuminated can be directed onto a receiver positioned in the other focus. Such transmitters and receivers will be referred to in the following text as transceivers or simply as radiators. In this context different scenarios are possible depending on whether a radiator or transceiver functions as a transmitter or as a receiver.

One such scenario relates to a reflector according to the invention having a surface configuration that is not frequency selective. In this case each radiator that is arranged in one of the focuses directs its beams toward the region to be illuminated. Beams coming from the area to be illuminated are focused on all the focuses of the reflector. The transmitting radiator can thus simultaneously function as a receiver radiator.

If additional radiators are used and positioned in the other focuses, these additional radiators should be operated at another frequency. The reception of the beams focused onto the focuses by receiver radiators other than the intended receiver radiator does not lead to any impairment of these other radiators because, on the one hand a frequency specific tuning of the receiver radiators takes place, and on the other hand the received power is frequently well below the transmitting power of the respective radiator.

However, if in addition to the transmitting radiator a separate receiver radiator is provided in another focus, no adverse influencing of the transmitting radiator by the received beam focused into the focus of the transmitting radiator takes place because again the received power is usually well below the transmitting power of the respective radiator.

Another scenario relates to a reflector according to the invention having a frequency selective surface configuration. One use for such a reflector involves a radiator positioned in a focus and functioning exclusively as a transmitter operating at a fixed frequency or within a certain frequency band while a second radiator is positioned in another focus and functions only as a receiver for another frequency or for another frequency band. A received beam is then focused by the frequency selective effect of the reflector only on the receiver radiator.

The present reflector is also operable in connection with beams in which the individual electromagnetic beams have different polarizations. In this manner it is possible to achieve in addition to the spatial separation a further decoupling by using several focuses. According to another embodiment it is possible that the beams allocated to different focuses have identical polarization directions. Thus, a reflector according to the invention has the advantage that merely a single reflector is required for a decoupled transmission of electromagnetic waves having any random polarization direction. As a result, a system according to the invention is simpler and more effective than respective conventional systems.

The configured surface of the reflector may be so arranged that the reflector has only two focuses so that electromagnetic beams, for example beams tuned to different frequencies or to different frequency bands can be directed onto a common region to be illuminated, whereby the beams emanate from two spatially separated radiators which are arranged in the focuses. Thus, the present reflector structure needs to be adapted only to two radiation sources.

However, the surface configuration of the reflector may be adapted for cooperation with more than two focuses. Hence, the reflector can comprise more than two focuses and so that more than two radiators can be used, whereby their beams are focused onto respective regions to be illuminated. Several groups of spatially separated radiators may be provided, whereby the surface configuration of the reflector is so constructed that the electromagnetic beams emanating from a first group of spatially separated radiators is directed onto a first common region to be illuminated, whereby these beams may, for example, be tuned to different frequencies or different frequency bands. Further, the electromagnetic beams emanating from a second group or possibly further groups of spatially separated radiators are directed or focused on a second common region to be illuminated. Each of the individual groups may comprise two or more radiators. The individual radiators of a group may be operated relative to one another, for example at different frequencies or in different frequency bands which can be used in all groups in parallel, whereby the different frequencies or bands used in one group may also be used in the other groups of radiators. However, it is also possible to use within one group the same frequencies for several radiators as has been described above.

A particular reflector may comprise individual surface areas which are allocated to or effective for one region to be illuminated. Moreover, these surface areas may be tuned to one frequency or to one frequency band. Thus, it is not necessary to construct the entire reflector surface in such a way that it achieves as a unit the desired focusing effect for the individual beams. Hence, it is not necessary according to the invention to completely illuminate the entire reflector surface by any individual beams. This feature has the advantage that the illumination can be limited to reflector surface areas that are effective for a certain region to be illuminated and, as applicable, for a certain frequency or a certain frequency band, whereby it is possible to substantially optimize the reflector surface for the individual frequencies or for the individual regions to be illuminated.

According to the invention the present reflector may comprise surface areas for isolating or rather blanking out regions which are neighboring regions to be illuminated. Such a blanking effect has the advantage that the illumination is substantially limited to the individual regions to be illuminated and that neighboring regions, particularly also regions between regions to be illuminated are not exposed to adverse stray illuminations, for example by secondary lobes or cross-polar components of the beams, whereby any adverse characteristics are substantially reduced. This feature of the invention makes it possible to blank out regions that must not receive illumination from neighboring regions that are to be illuminated, so that illumination in these blanked out regions is positively avoided. If separate areas of the reflector surface are allocated to this purpose of blanking out, it is possible that these allocated areas can be optimized substantially independently of other reflector surface areas in order to achieve the desired effect as ideally as possible. However, separate reflector surface areas need not necessarily be used since it is possible to utilize for the purpose of blanking out reflector surface areas which are simultaneously used for neighboring regions to be illuminated and in which, if applicable, other frequencies or other frequency bands are effective.

To start with the overall reflector surface configuration may for example be a plane surface or a curved surface on which a fine structure of bumps and dents is superimposed in localized areas The reflection effectiveness or efficiency is thus provided on the one hand by the overall configuration of the reflector surface (plane or curved) and on the other hand the reflection efficiency can be adapted or optimized by the local configurations of the reflector surface areas with regard to the region to be illuminated or the region to be blanked out and, if applicable, it can also be optimized for the individual frequencies or frequency bands.

The local configuration of the reflector surface may, similar to a fractal structure, comprise several stages of fine structures bumps and dents of diminishing magnitudes thereby providing a respective topography. Thus, a first local surface area configuration having a first small given magnitude or dimension for the bumps and dents is superimposed on the overall surface structure of the reflector body. A further localized surface area configuration of even smaller dimensions is superimposed on the first localized surface structure to modify the topography of the localized reflector area. If required, further stages of localized bumps and dents may be superimposed on preceding stages of bums and dents and each of the following stages of localized surface area configurations will have diminishing dimensions that become progressively smaller and smaller.

As mentioned, the invention also comprises an antenna system including a reflector with a configured surface according to the invention. Such an antenna system comprises at least one group of first and second radiators. The first radiators of a group are spatially separated from the second radiators of the same group. Without limiting the invention to one group of two radiators, the example to be described will comprise at least one group with two radiators. The first and second radiators are arranged respectively in a focus of the reflectors in such a way that first and second beams emanating from the first and second radiator respectively will be directed onto a common region to be illuminated. The first radiator functions as a transmitter while the second radiator functions as a receiver. One thus obtains an antenna system which permits in a simple manner a decoupled, bidirectional transmission of electromagnetic waves for transmitting and receiving purposes. A further embodiment of the antenna system according to the invention comprises a first radiator constructed and tuned for beams with a first frequency or a first frequency band and a second radiator for beams with a second different frequency or second different frequency band. Such an antenna system is especially suitable for use in communications, whereby the transmitter is constructed and tuned for operation with the first frequency or in the first frequency band and the receiver is constructed and tuned for operation with the second frequency or second frequency band.

The arrangement of the first and second radiators and the structuring or configuring of the reflector surface can be such that each radiator illuminates the entire region to be illuminated. Such a system is simple since it requires for the illumination of the region to be illuminated only one radiator for the transmitter operating at a certain frequency or within a certain frequency band, and only one further radiator operating as a receiver preferably at a second frequency or in a second frequency band. However, basically more than two radiators can be employed, whereby each of the radiators will preferably work at its own different frequency or within its own different frequency band.

Another embodiment of the antenna system according to the invention comprises several groups of individual radiators, whereby a first group has first and second radiators arranged to direct their beams onto a first region to be illuminated. The individual radiators may operate at different frequencies or in different frequency bands. In such a system at least one second group of radiators is provided for directing beams onto a second region to be illuminated, whereby the second region differs from the first region. The radiators of the second group may be constructed and tuned for operation at different frequencies or in frequency bands, whereby the individual groups relative to each other may use the same frequencies or frequency bands. Basically more than two groups of radiators may be provided in the present antenna system. These groups are spatially separated from one another and each individual group comprises at least two individual radiators.

According to the invention there is further provided a method for ascertaining the surface configurations of the present reflector, whereby the reflector comprises at least one group of spatially separated focuses. The method may, for example, be performed by simulation with the aid of a computer program or it may be performed by repeated mechanical deformation, such as embossing, of the reflector surface.

The present method is performed by starting with an original overall reflector surface still without smaller deformations, whereby the overall surface is, for example, a plane surface or curved surface such as a surface having a parabolic curvature. Then the reflection effect of the original radiator surface is determined for a given position of at least two radiators operating at different frequencies.

Next, a relatively rough deformation or structuring of the reflector surface is applied to at least one localized area of the reflector surface by forming bumps and dents in the localized area, for example by embossing for modifying or varying the reflection effect of the reflector in such a way that for the fixed position of the individual radiators a rough directional effect is imposed on the beams for directing the beams onto the desired region to be illuminated. Thus, in this first step a rough formation of spatially separated focuses is accomplished at the position of the radiators.

Preferably in a second step the reflection effect is optimized by superimposing on the first embossing or structuring a second embossing in the form of a localized structuring of the reflector surface with smaller dimensions of the bumps and dents. These second bumps and dents with smaller dimensions are formed in the bumps and dents of the first deformation or structuring step. This optimizing of the reflection effect can be continued by a third embossing operation and so forth until the directional effect of the radiators onto the common region to be illuminated is improved to the desired extent, whereby the formation of spatially separated focuses at the locations of the radiators is optimized.

As mentioned, the localized structuring for example by embossing of the reflector surface can, if required, be continued with further steps each involving smaller dimensions of the bumps and dents until the required directional effect is achieved. Thus, one obtains a type of fractal structure of the reflector surface with different configurations having different progressively smaller dimensions.

With the aid of the above described repetitive steps for optimizing the directional effect, the spatial position of the individual radiators and the orientation of these radiators, that is the angle relative to one another and to the reflector, may be varied, whereby the position and size of the region to be illuminated by the reflector can be varied. Thus, it is assured that in each case an overall optimum is achieved by the individual optimizing steps.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
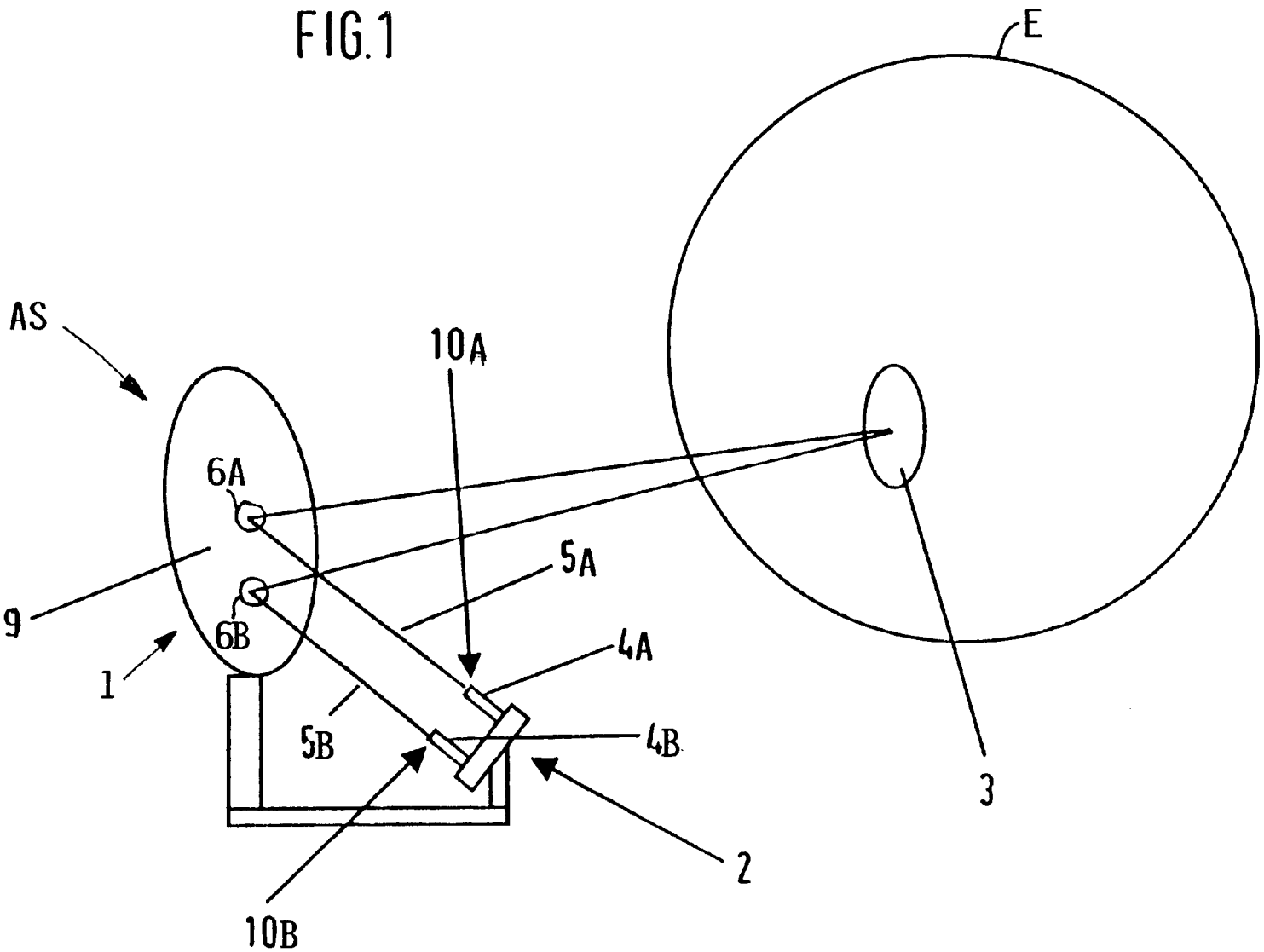
FIG. 1 illustrates schematically an antenna system according to the invention.

FIG. 1 shows an antenna system AS according to the invention, for example useful for a communications system in a ground station and/or in a communications satellite. The antenna system AS comprises a reflector 1 having a surface configured according to the invention. A first group 2 of two radiators 4A and 4B is so positioned that beams emanating from these radiators illuminate at least partially the surface of the reflector 1 when the reflector is used in a transmitter station. The radiators 4A and 4B are tuned to operate at different frequencies or in frequency bands. Further, the radiators 4A and 4B are spatially separated from one another and from the reflector surface. The radiator 4A is arranged in a focus 10A of the reflector 1. The radiator 4B is arranged in a focus 10B of the reflector 1. The beams 5A and 5B emitted from the radiators 4A and 4B, respectively, are so reflected by the surface of the reflector 1 that a common region 3 for example on the earth E is illuminated by the reflector 1. Illustrating the region 3 to be illuminated on the earth's surface is just one possible example of the use of the present antenna system in a communication satellite.

If it is intended that one of the radiators functions as a transmitter while the other functions as a receiver, one of the beams, for example 5B, would be directed in the opposite direction from the reflector 1 to the focus 10B. Localized reflector surface areas are formed on the reflector 1 by localized working such as embossing to form frequency selective reflector surface areas so that a beam 5B emanating from the region 3 will be focused onto the receiver focus l0B of the radiator 4B.

Figure 2:
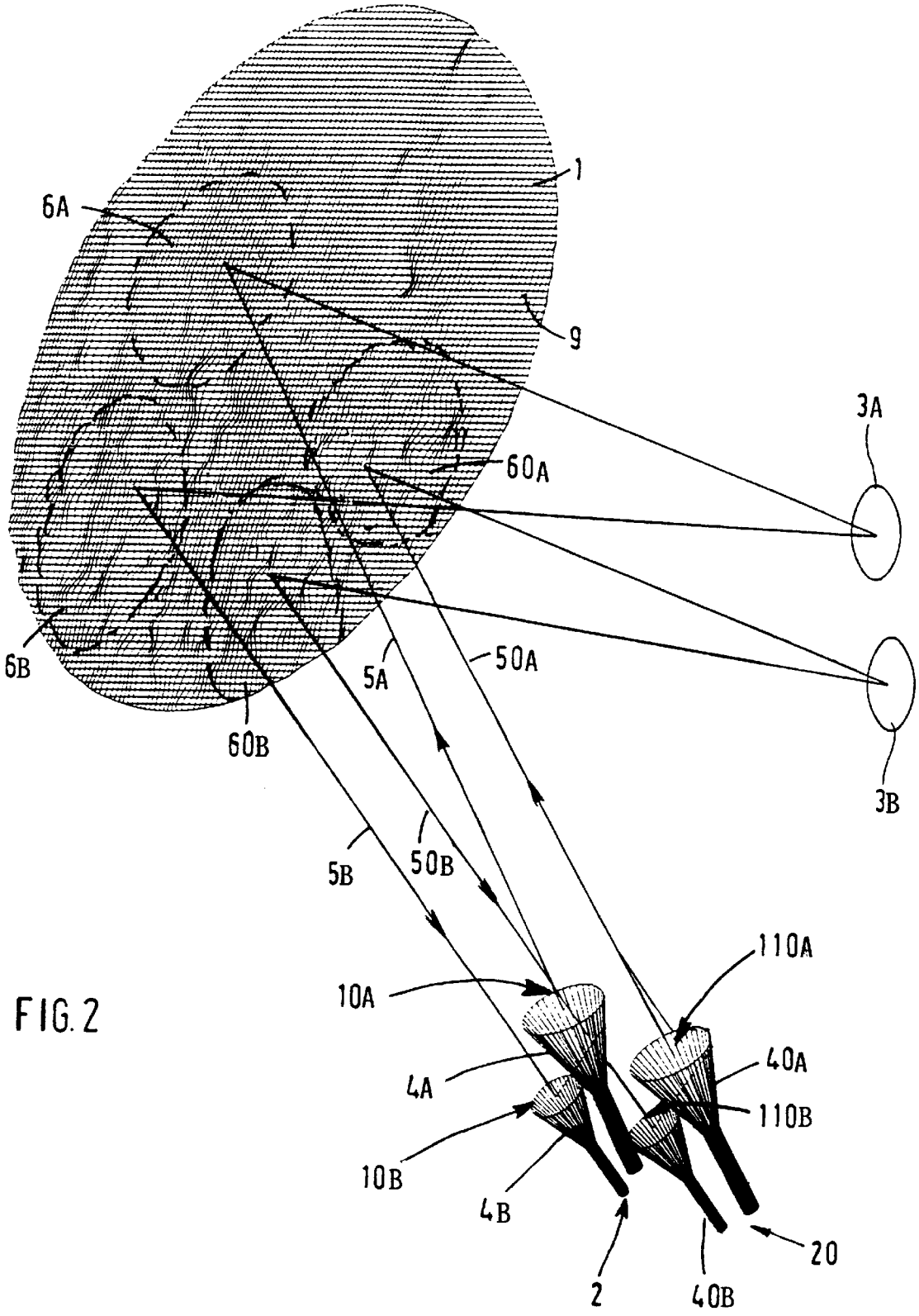
FIG. 2 illustrates perspectively and schematically the illumination of a reflector according to the invention by a plurality of radiators positioned in the focuses of the reflector.

FIG. 2 shows the illumination of the reflector surface 9 of the reflector 1 by a plurality of radiators 4A, 4B, 40A and 40B. These radiators form two groups. The first group 20 contains radiators 4A and 4B. A second group 20 contains radiators 40A and 40B. The radiators of the second group are arranged in the focuses 110A and 110B. In the first group the radiator 4A operates as a transmitter and transmits the beam 5A while the second radiator 4B operates as a receiver and receives the beam 5B. These two beams 5A and 5B operate at different frequencies or in different frequency bands. The second group 20 operates analogously, whereby the beam 50A is transmitted by the radiator 40A while the radiator 40B receives the beam 50B. The beams 50B and 5B operate at different frequencies or in different frequency bands. However, the beams 5A, 5B, 50A and 50B of both groups 2 and 20 of radiators may be tuned to have the same frequency or operate in the same frequency bands. For example, the beam 5A may operate at the same frequency or in the same frequency band as the beam 50A. Similar considerations apply to the beams 5B and 50B.

Moreover, the individual beams may have any desired polarization. For example, the beams 5A and 5B may have the same polarization without thereby impairing the system's ability to function properly.

The two groups of radiators 2 and 20 are positioned relative to the reflector 1, more specifically relative to the surface 9 of the reflector 1, in such a way that each of the radiators 4A, 4B, 40A and 40B illuminates, as a transmitter, primarily a defined surface area 6A, 6B, 60A and 60B on the reflector surface 9. Each of these surface areas is thus almost exclusively allocated to a determined region 3A, 3B to be illuminated and effective for operation at a certain frequency or in a defined frequency band. This allocation applies correspondingly when the radiators operate as receivers whereby the beam direction is reversed, because both beam directions are correspondingly influenced by the reflector. The present system thus has a reciprocal characteristic.

Figure 3:
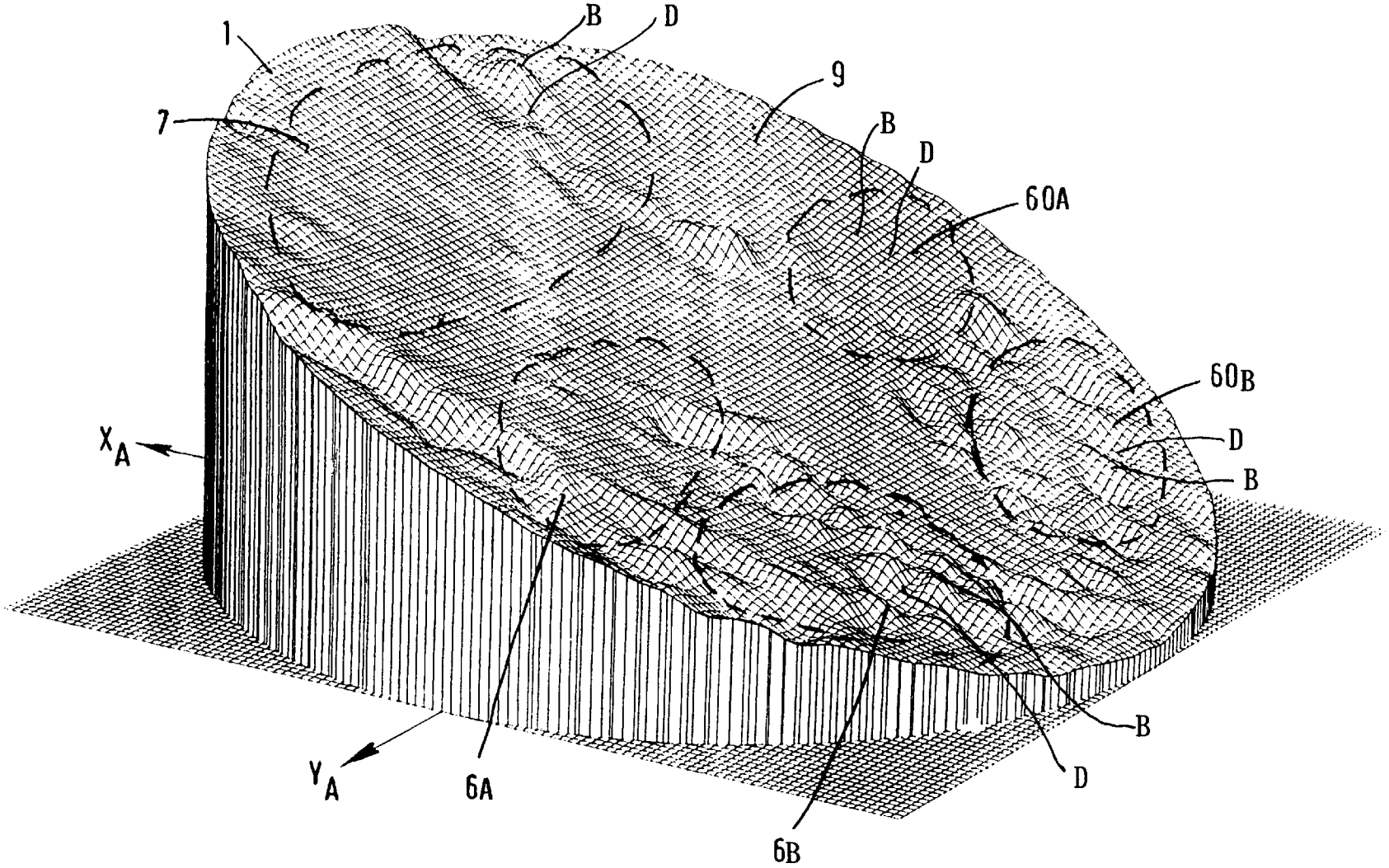
FIG. 3 is a schematic illustration of the surface topography of a reflector according to the invention.

FIG. 3 illustrates the configuration of the reflector surface 9. In this example the overall surface 9 is part of a parabolic curvature with localized areas of deformations or configurations formed by local bumps B and local dents D. These bumps or protrusions B and dents D have localized different dimensions. A first set of bumps B and dents D has a first larger dimension. A second set of such bumps and dents superimposed on the first set of bumps and dents has smaller dimensions than the first set and so forth. These localized bumps B and dents D are primarily present in the structurized areas 6A, 6B, 60A and 60B which are effective for the individual regions 3A, 3B to be illuminated or for the respective frequencies or frequency bands. FIG. 3 further shows a structured area 7 on the reflector surface 9. This area 7 forms a separate isolated or rather blanked out region 8 on earth E as shown in FIG. 4.

Figure 4:
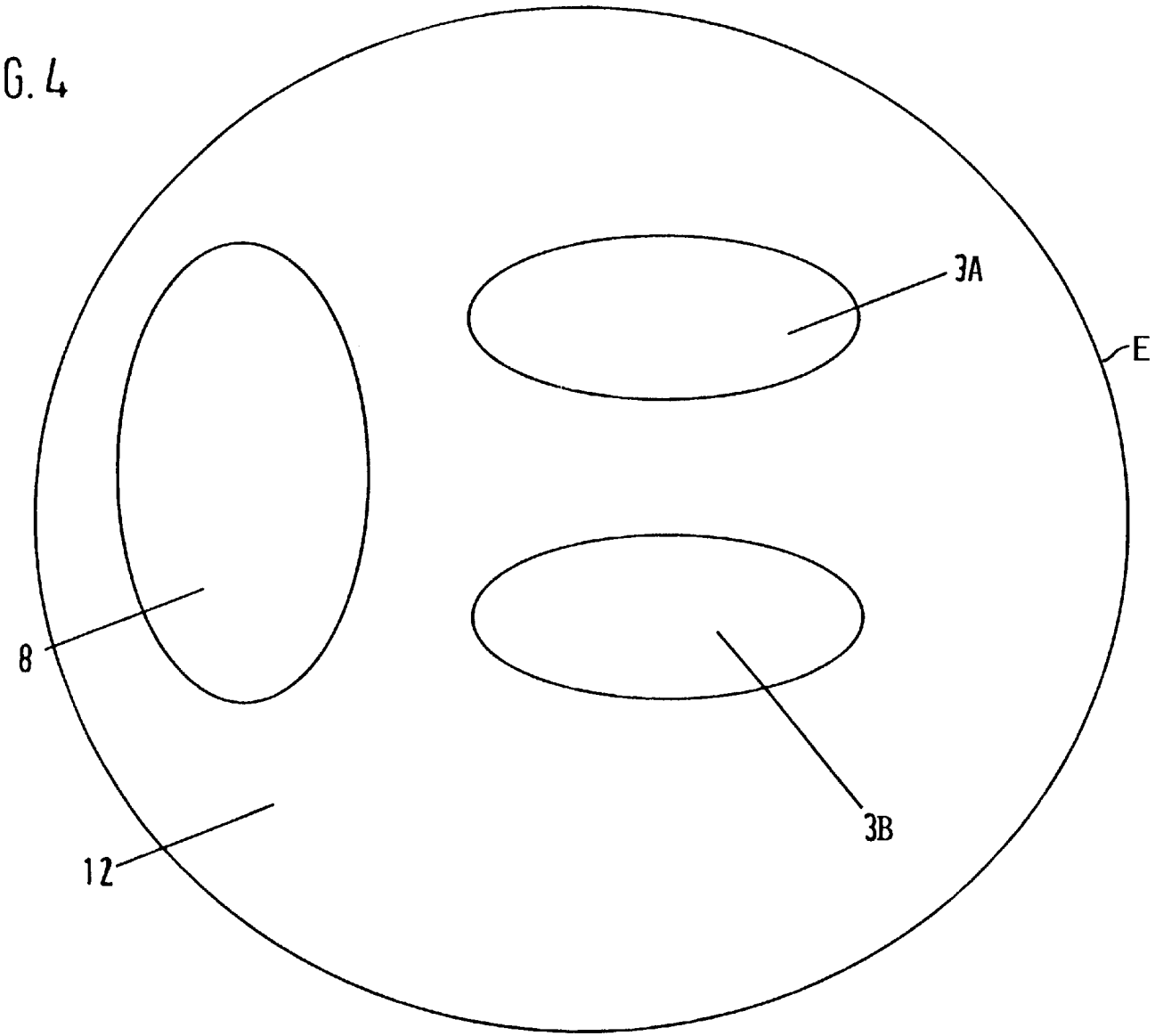
FIG. 4 is a schematic illustration of separate regions to be illuminated and regions blanked out from being illuminated by an antenna system according to the invention.

Referring to FIG. 4, the blanked out region 8 serves for isolating a portion of the earth's surface 12 from other regions so that in the region 8 neither reception nor transmission is possible relative to the present system. However, the structured reflector surface area 6A directs the beam 5A onto the respective region 3A to be illuminated as shown in FIG. 4. The structured reflector surface area 6B makes sure that the beam 5B emanating from the respective region 3A is focused onto the focus 10B of the radiator 4B if and when the latter functions as a receiver. In an analogous manner the structured areas 60A and 60B serve for directing the beam 50A onto the second region 3B to be illuminated or to direct the beam 50B onto the radiator 40B if the latter operates as a receiver, see FIG. 2.

A further isolation effect or blanking out is required for directing the beams exclusively onto the regions 3A and 3B to be illuminated to make sure that for all practical purposes only the respective region is illuminated that the beams do not reach into any neighboring region where interferences could be caused without such further isolation effect. Such a further isolation or blanking out effect can also be achieved by a respective adaptation of the reflector surface 9 as described above with regard to the reflector surface area 7. Assuming, for example that the illumination of the region 3A is accomplished by the reflector areas 6A and 6B. Assuming further that there is a danger that stray radiation from these reflectors areas 6A and 6B could reach the region 3B to be illuminated. To avoid this problem, the reflector areas 60A and 60B could be adapted to perform a blanking function in addition to their above described reflector function. Assuming that stray radiation from the beam 5A reaches the reflector areas 60A and 60B can be structured to direct this stray radiation from the beam 5A onto the area 3B in such a manner that it destroys any stray radiation that emanates from the reflector areas 6A and 6B onto the region 3B to be illuminated. In other words, the two stray radiations destructively interfere with each other, whereby the effective stray radiation in the area 3B is reduced to zero for all practical purposes. Analog considerations apply to the illumination of the region 3B and any stray radiation caused thereby in the region 3A to be illuminated.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A reflector for electromagnetic waves, said reflector comprising a reflector body having a configured reflector surface, said configured reflector surface comprising a plurality of localized surface areas, said reflector further comprising at least one group of spatially separated focuses, each of said localized surface areas having a surface topography with bumps and dents adapted for cooperation with said at least one group of spatially separated focuses for directing electromagnetic beams emanating from said respective group of spatially separated focuses onto a region to be illuminated by said electromagnetic beams or for receiving electromagnetic beams emanating from a respective region, and wherein said bumps and dents of said localized surface areas have progressively smaller dimensions starting from a given first dimension of the bumps and dents of a first localized surface area of said configured reflector surface.

2. The reflector of claim 1, wherein said localized surface areas with said bumps and dents are limited in area size relative to said configured reflector surface.

3. The reflector of claim 1, wherein said at least one group of spatially separated focuses comprises a first set of at least two focuses, and wherein said configured reflector surface and said surface topography of said localized surface areas are constructed for cooperation with said first set of at least two focuses so that said electromagnetic beams are directed onto a first region to be illuminated.

4. The reflector of claim 3, comprising at least one further group of spatially separated focuses including a second set of at least two focuses, and wherein said configured reflector surface and said surface topography of said localized surface areas are constructed for also cooperating with said second set of at least two focuses so that respective second electromagnetic beams emanating from said second set of focuses are directed onto a second region to be illuminated.

5. The reflector of claim 1, wherein said surface topography has a frequency selective surface configuration.

6. The reflector of claim 1, wherein said bumps and dents having said given first dimension form a first set of bumps and dents, said reflector further comprising at least one second set of bumps and dents having a smaller dimension than said given first dimension, and wherein said second set of bumps and dents is superimposed on said bumps and dents forming said first set of bumps and dents.

7. An antenna system for electromagnetic radiation, said system comprising a reflector with a configured reflector surface according to claim 1, said antenna system further comprising at least one first radiator positioned in a first focus of said configured reflector surface and at least one second radiator positioned, spatially separated from said at least one first radiator, in a second focus of said configured reflector surface, said first and second radiators forming a first group of radiators, which is so arranged relative to said first and second focuses that electromagnetic beams emanating from said first and second radiators are directed onto a common region to be illuminated.

8. The antenna system of claim 7, wherein said at least one first radiator is constructed as a transmitter, and wherein said at least one second radiator is constructed as a receiver.

9. The antenna system of claim 7, wherein said at least one first radiator is constructed for handling beams at a first frequency or in a first frequency band, and wherein said at least one second radiator is constructed for handling beams at a second frequency or in a second frequency band.

10. The antenna system of claim 7, wherein said first radiators and said second radiators are separated into two groups so that the second radiators are spaced from said first radiators in such a position that electromagnetic beams emanating from said first radiators are directed onto a first region to be illuminated, and so that electromagnetic beams emanating from said second radiators are directed onto a second region to be illuminated.

11. The antenna system of claim 7, comprising a plurality of first radiators and a plurality of second radiators, wherein each of said first and second radiators is arranged in such a manner that in combination with the configuration of said reflector surface area each of the first and second radiators illuminates the entire region to be illuminated.

12. A method for determining a surface configuration for a reflector for electromagnetic waves, said method comprising the following steps:

(a) simulating a base reflector surface configuration of said reflector, (b) defining spatially separated positions of radiators relative to said base reflector surface configuration in such a way that each radiator illuminates at least one localized reflector surface area of said reflector surface configuration, (c) determining a reflection effect of said reflector surface configuration relative to electromagnetic beams emanating from radiators located in said spatially separated positions defined in step (b), (d) varying a topography in the form of bumps and dents of said at least one localized reflector surface area by making said bumps and dents progressively smaller than any bumps and dents of a preceding topography so that electromagnetic beams emanating from said radiators are directed onto a common region to be illuminated, and (e) repeating steps (c) and (d) with progressively smaller dimensions of said bumps and dents until a defined directional effect of said electromagnetic beams onto said common region to be illuminated is achieved.

13. The method of claim 12, further comprising varying during said step (d) said spatially separated positions of said step (b), relative to said reflector.

14. The method of claim 12, further comprising varying during said step (d) an orientation of said radiators relative to said reflector.

15. The method of claim 12, wherein said varying step comprises superimposing on a first set of bumps and dents having a first given dimension, at least a second set of bumps and dents having a second dimension smaller than said first given dimension.

* * * * *

UNITED STATES PATENT AND TRADEMARK OFFICE

CERTIFICATE OF CORRECTION

PATENT NO. : 6,255,997 B1
DATED : July 3, 2001
INVENTOR(S) : Ratkorn et al.

It is certified that error appears in the above-identified patent and that said Letters Patent is hereby corrected as shown below:

Column 2,
Line 38, before "separated", replace "spatilly" by -- spatially --; after "separated", replace "focises" by -- focuses --;
Line 41, after "directing", replace "electromagnetix" by -- electromagnetic --;
Line 44, after "receiving", replace "electromagentic" by -- electromagnetic --;
Line 61, after "for" (first occurrence), replace "determaining" by -- determining --;
Line 64, after (a), replace "stimulating" by -- simulating --;
Line 66, after "defining", replace "spatial" by -- spatially --;

Column 3,
Line 3, after "a", replace "reflectoion efefct of said refector" by -- reflection effect of said reflector --;
Line 5, after "located", replace "inn" by -- in --;

Column 8,
Line 36, after "group", replace "20" by -- 2 --;
Line 38, after "40B.", insert -- The radiators of the first group are arranged in the focuses 10A and 10B. --.

Signed and Sealed this

Nineteenth Day of February, 2002

*Attest:*

*Attesting Officer*

JAMES E. ROGAN
*Director of the United States Patent and Trademark Office*